US005699691A

United States Patent [19]

Maruyama

[11] Patent Number: 5,699,691

[45] Date of Patent: Dec. 23, 1997

[54] ADJUSTING APPARATUS FOR ROLL THREADING DIE HEAD

[75] Inventor: Masaaki Maruyama, Soraku-gun, Japan

[73] Assignee: Rex Industries Co., Ltd., Japan

[21] Appl. No.: 515,142

[22] Filed: Aug. 15, 1995

[30] Foreign Application Priority Data

Aug. 15, 1994 [JP] Japan ..... 6-191603

[51] Int. Cl.[6] ..... B21B 31/26; B21H 3/04

[52] U.S. Cl. ..... 72/104; 72/121

[58] Field of Search ..... 72/104, 121

[56] References Cited

U.S. PATENT DOCUMENTS 859,642 4/1907 Cummings ..... 72/121

FOREIGN PATENT DOCUMENTS 510513 4/1952 Belgium .
372688 4/1907 France .
1061728 7/1959 Germany .
1078526 3/1960 Germany .
63-16826 1/1988 Japan .
3-14035 2/1991 Japan .
703197 12/1979 U.S.S.R. .
940968 7/1982 U.S.S.R. ..... 72/104
1072968 2/1984 U.S.S.R. .

*Primary Examiner*—Lowell A. Larson
*Attorney, Agent, or Firm*—Merchant, Gould Smith, Edell Welter & Schmidt, P.A.

[57] ABSTRACT

An adjusting apparatus for a roll threading die head with a head body having a plurality of threading rollers located on an imaginary circle concentrical to an axis of a cylindrical workpiece to be threaded. There are provided eccentric bearings which rotatably support the corresponding threading rollers and which are rotatable about axes eccentric with respect to the axes of rotation of the respective threading rollers. The eccentric bearings are simultaneously rotated by a rotor about their axes by the same angular displacement.

6 Claims, 4 Drawing Sheets

ADJUSTING APPARATUS FOR ROLL THREADING DIE HEAD

BACKGROUND OF THE INVENTION

1. Field of the Invention

The present invention generally relates to a die head having threading rollers (thread rolling dies) for rolling a thread on a cylindrical workpiece, and in particular, to an adjusting apparatus which performs a fine adjustment of positions of the threading rollers in radial directions.

It is known to form a thread on a cylindrical workpiece, such as a pipe or rod, etc., by plastic deformation, using threading rollers (roll threading dies).

2. Description of Related Art

For instance, in a known die head 50 for forming a taper thread, as shown in FIGS. 7 and 8, there are provided a plurality of threading rollers 51 which are located on an imaginary circle C whose center is located on an axis X—X of a pipe P (workpiece) to be threaded to surround the pipe at a predetermined angular distance. (Note that no die head is shown in FIG. 8 for the purpose of clarity).

The threading rollers 51 are each provided with a shaft portion 52 which is rotatably supported by a bearing 55 which is in turn supported by the die head 50. Each threading roller 51 is provided on the outer peripheral surface thereof with a taper thread (male screw) corresponding to a taper thread to be formed (or rolled) on the outer peripheral surface of the pipe P. The pipe P is inserted in a center opening defined by the threading rollers 51 in the axial direction Y. Thereafter, the threading rollers 51 are pressed onto the pipe P with a high pressure. Consequently, a taper thread S is formed on the end Pe of the pipe P. It goes without saying that the pipe P or the die head 50 is relatively rotated (in general, the die head 50 is rotated) during the thread rolling.

Since the threading rollers 51 receives an extremely high pressure (reaction) in the course of the thread rolling, the threading rollers 51 are usually secured to the die head 50. Namely, the axial positions of the threading rollers 51 are fixed and are not adjustable. In other words, one die head is prepared for one diameter of pipe P (one size-one die head).

However, in the die head as constructed above, an adjustment, and in particular, a fine adjustment of the position of the threading rollers 51 in the radial direction r (FIG. 8) is sometimes needed. For example, the diameter of the thread S to be formed on the pipe P varies depending on the usage of the pipe (for gas or water, etc.), or joining conditions under which a pair of pipes are to be connected through a pipe joint, etc., within a range of 0.5 mm to 0.6 mm. Moreover, in the case that the threading rollers 51 or the bearings thereof are worn after long use, if it is possible to move the threading rollers in the radial direction, the wear could be effectively absorbed. Namely, a fine adjustment of the threading rollers in the radial position makes it unnecessary to exchange the worn threading rollers with new ones, thus resulting in an increase in the service life of the threading rollers.

Nevertheless, there has been no fine adjustment mechanism for a roll threading die head, hitherto known.

SUMMARY OF THE INVENTION

The primary object of the present invention is to realize such a fine adjustment mechanism for a roll threading die head.

To achieve the object mentioned above, according to the present invention, there is provided an adjusting apparatus for a roll threading die head with a head body having a plurality of threading rollers located on an imaginary circle concentrical to an axis of a cylindrical workpiece to be threaded, wherein the improvement comprises eccentric bearings which rotatably support the corresponding threading rollers and which are rotatable about axes eccentric with respect to the axes of rotation of the respective threading rollers, and a rotor which simultaneously rotates the eccentric bearings about their axes by the same angular displacement.

Each of the threading rollers can be provided on an outer peripheral surface thereof with a taper thread to form a corresponding taper thread on the workpiece.

Preferably, the rotor is comprised of a single cam which is engaged by the threading rollers.

Preferably, the cam is provided with outer teeth which are in mesh with an external gear provided on the head body.

The cam can be provided with radially elongated grooves corresponding to the eccentric bearings, wherein the eccentric bearings are provided with pins which are movably fitted in the corresponding elongated grooves of the cam.

In another embodiment, the rotor is comprised of a rotating plate which is provided with inner teeth and the eccentric bearings are provided with outer teeth which are engaged by the inner teeth of the rotating plate.

The shafts for rotating the threading rollers are rotatably fitted in eccentric holes formed in the eccentric bearings.

The axes of the shafts are eccentric with respect to the axes of the rotation of the respective eccentric bearings.

BRIEF DESCRIPTION OF THE DRAWINGS

The invention will be discussed below in detail with reference to the accompanying drawings, in which.

DESCRIPTION OF THE PREFERRED EMBODIMENT

Figure 1:
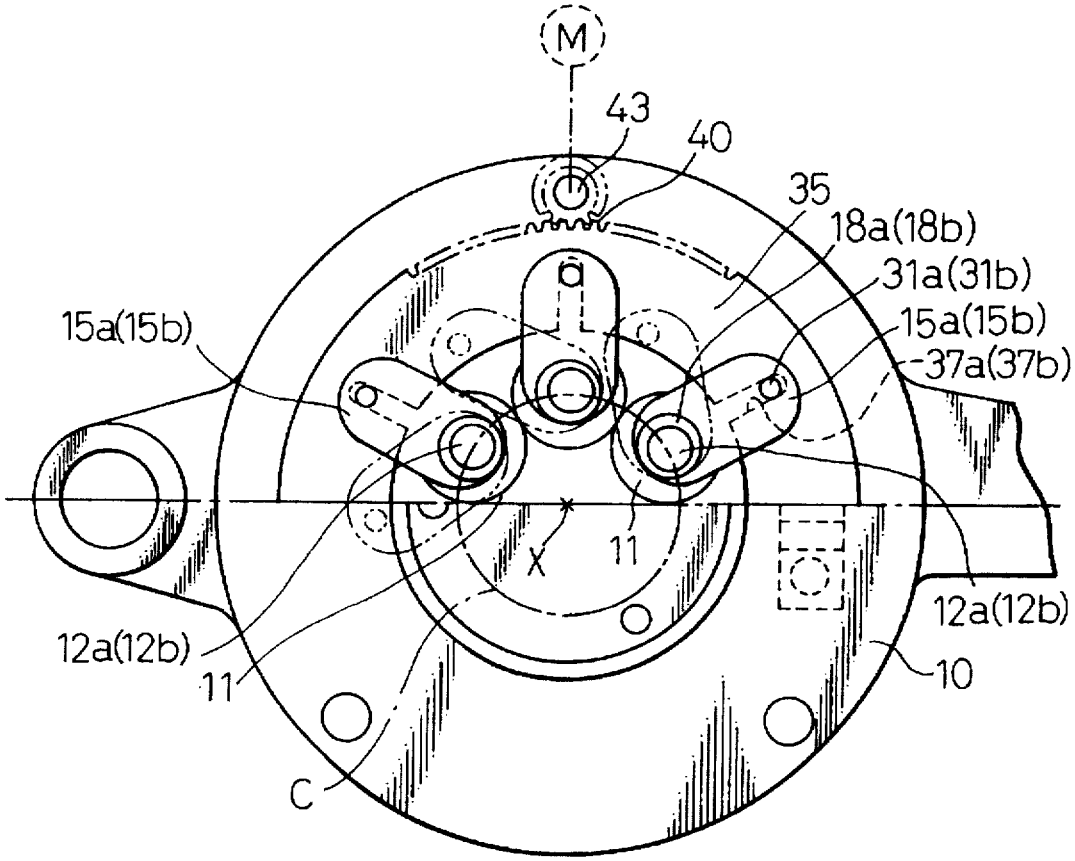
FIG. 1 is a schematic front elevational view of a fine adjustment apparatus for a thread rolling die head according to the present invention.
Figure 2:
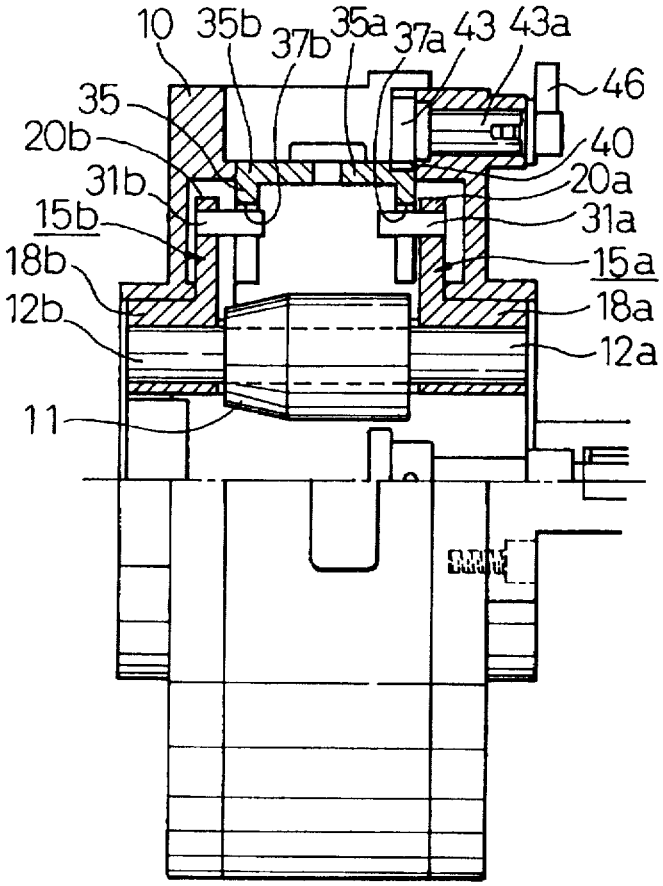
FIG. 2 is a partially sectioned side view of FIG. 1.

FIGS. 1 and 2 show a whole structure of a roll threading die head according to the present invention.

Figure 3A:
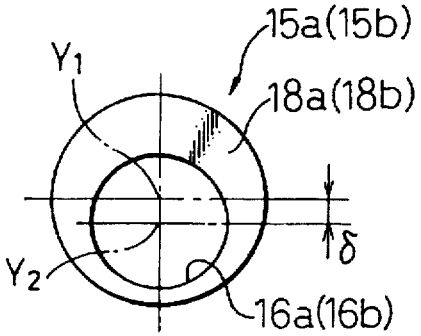
FIGS. 3*a* and 3*b* are a front elevational view and a side sectional view respectively of an eccentric bearing used in the present invention.
Figure 3B:
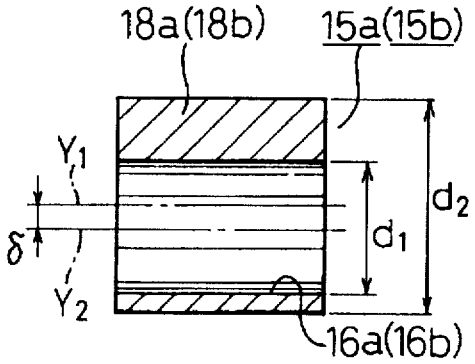
Figure 7:
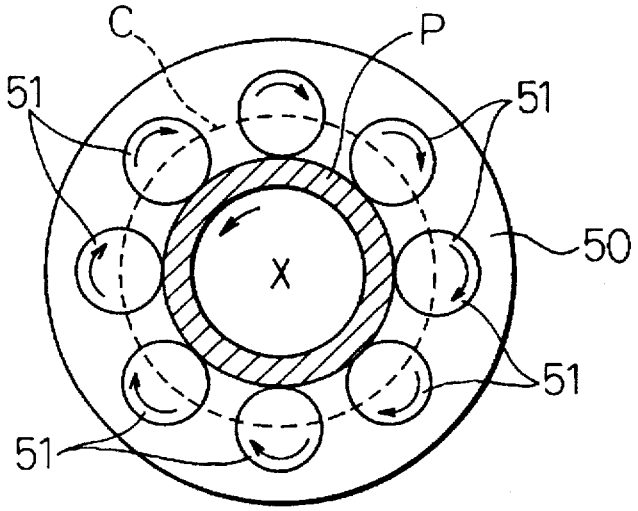
Fig. 7 (PRIOR ART)
FIG. 7 is a front elevational view of a basic structure of a known roll threading die head; and, FIG. 8 is a partially sectioned side view of FIG. 7.
Figure 8:
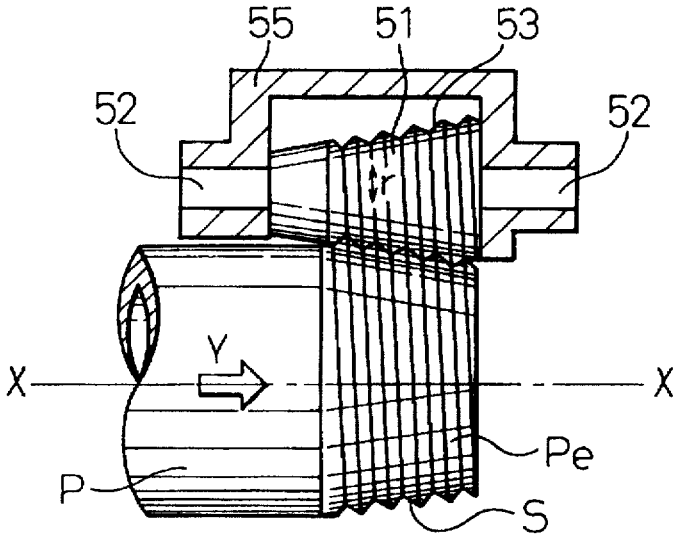
Fig. 8 (PRIOR ART)

In FIGS. 1 and 2, a die head body 10 whose front shape is substantially a circular disc is provided with, for example, eight threading rollers 11 (only three rollers are shown in FIG. 1) which are located at an equiangular distance of 45°, on an imaginary circle C whose center is located on the center axis X of the workpiece P (FIGS. 7 and 8) to be threaded, similarly to FIG. 7. Each threading roller 11, which is identical to the threading roller 51 shown in FIGS. 7 and 8, is provided with first and second rotating shafts 12*a* and 12b which are rotatably supported by respective front and rear bearings 15a and 15b. The bearings 15a and 15b are in the form of eccentric bearings, according to the present invention. Namely, as can be seen in FIGS. 3a and 3b, the eccentric bearing 15a (or 15b) is provided with a cylindrical bearing portion 18a (18b) having a bearing hole 16a (16b) of an inner diameter δ whose center axis Y2 is eccentric by an eccentricity δ with respect to the center axis Y1 of the cylindrical bearing portion 18a (18b) having an outer diameter d2. The shaft portions 12a and 12b of each threading roller 11 are fitted and supported in the bearing holes 16a and 16b of the bearing portions 18a and 18b.

Figure 4A:
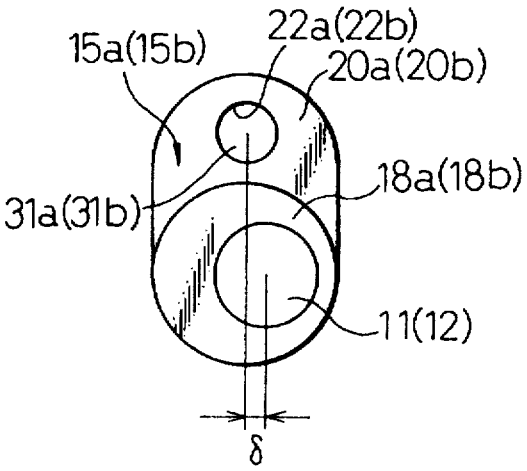
FIGS. 4*a* and 4*b* are front elevational views of an eccentric bearing and a threading roller in different positions.
Figure 4B:
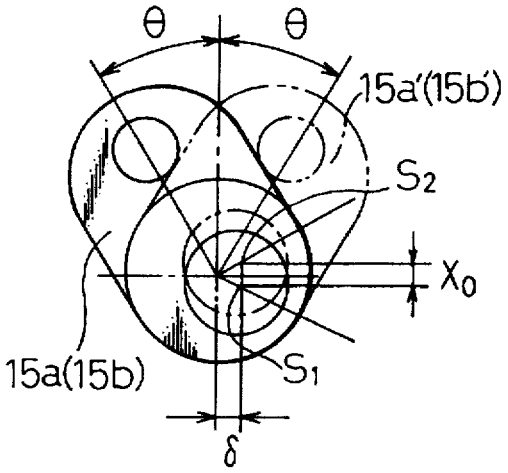

FIGS. 4a and 4b show a shape of the eccentric bearing 15a (15b) by way of example. The cylindrical bearing portion 18a (18b) is provided on its one end with a flange 20a (20b) which integrally projects in a radial direction. The flange 20a (20b) is provided with a through hole 22a (22b). Consequently, when the eccentric bearing 15a (15b) is rotated about the axis Y1 of the cylindrical bearing portion 18a (18b) by a pivot pin 31a (31b) inserted in the through hole 22a (22b), the center axis of the shaft portion 12 (12a, 12b) of the threading roller 11 inserted in the bearing holes 16a and 16b of the eccentric bearing 15a (15b) is displaced. The displacement (deviation) of the threading roller 11 (i.e., the shaft portion 12) is shown in FIG. 4b. In FIG. 4b, the eccentric bearing 15a (15b) is moved (rotated) from a first angular position indicated by a solid line to a second angular position indicated by a phantom line 15a'(15b'), about the center axis Y1 of the bearing portion 18a (18b), by an angle 2θ. Namely, the eccentric bearing 15a (15b) oscillates through the pivot pin 31a (31b) by an angle 2θ. Consequently, the threading roller 11, and more precisely, the center axis of the shaft portion 12 (12a, 12b) is moved from a first center position S1 to a second center position S2. Namely, the center of the threading roller 11 is deviated by Xo in the substantially radial direction.

Figure 5:
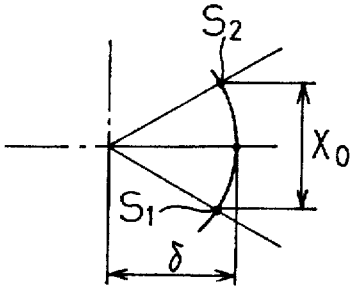
FIG. 5 is an explanatory view of an amount of eccentricity of a threading roller.

The deviation Xo is appropriately determined in accordance with the eccentricity δ. The direction of the deviation can be optionally selected in accordance with the direction of the oscillation of the eccentric bearing 15a (15b). The displacement of the center of the shaft portion 12 (12a, 12b) of the threading roller 11 from the first center position S1 to the second center position S2 is shown in an enlarged scale in FIG. 5.

Again, looking at FIGS. 1 and 2, the structure of the die head according to the present invention will be discussed below in more detail.

In FIG. 2, the die head is of a substantially symmetrical shape with respect to the center axis in the vertical direction. The front and rear (right and left in FIG. 2) bearing structures are substantially identical. In FIG. 1, the three eccentric bearings 15a (15b) are moved in the right and left directions by 2θ, corresponding to FIG. 4b.

A rotor 35 is rotatably mounted to the die head body 10 to rotate (oscillate) the eccentric bearings 15a (15b). The rotor 35 is made of front and rear annular plates 35a and 35b which are interconnected to have a substantially U-shape cross section. The annular plates 35a and 35b are each provided on the inner peripheral surface thereof with elongated grooves 37a (37b) extending in the radial direction. The number and location of the elongated grooves 37a (37b) correspond to those of the eccentric bearings 15a (15b). The pivot pins 31a (31b) are fitted in the corresponding elongated grooves 37a (37b). Consequently, the rotation of the rotor 35 causes the angular displacement (oscillation) of the eccentric bearings 15a (15b) by 2θ, through the pivot pins 31a (31b) and the elongated grooves 37a (37b), as mentioned above with reference to FIGS. 4a and 4b. In this sense, the rotor 35 functions as a cam to cause the oscillation of the eccentric bearings 15a (15b). Note that the positional relationship between the pivot pins 31a (31b) and the corresponding elongated grooves 37a (37b) is identical for any threading rollers 11. Thus, when the rotor 35 rotates, all the threading rollers 11 are moved in the substantially radial directions by the same distance at one time. Namely, a fine adjustment of the radial position of all the threading rollers by the same distance in the radial direction is carried out at one time.

To actuate (rotate) the rotor 35, the rotor 35 is provided, on the outer peripheral surface thereof, with outer teeth 40 (FIGS. 1 and 2) which are in mesh with an external pinion 43 which is rotatably supported by the die head body 10. The pinion 43 can be connected, for example, to a motor M to electrically rotate the same. Alternatively, it is possible to provide an external lever 46 which is connected to a rotating shaft 43a to which the pinion 43 is secured, so that the pinion 43 can be manually rotated by the external lever 46 from the outside of the die head body 10.

Figure 6:
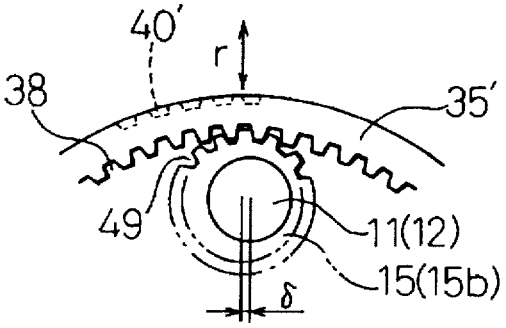
FIG. 6 is a schematic view of another embodiment of a rotating mechanism of a threading roller.

FIG. 6 shows another embodiment of the actuator for the rotor 35. The rotor 35 in the first embodiment is replaced with a rotor 35' in FIG. 6, which is in the form of a rotating ring which is provided on the inner peripheral surface thereof with inner teeth 38. The eccentric bearings 15a (15b) are provided on the outer peripheral surface thereof with outer sector teeth 49 which are in mesh with the inner teeth 38' of the rotor 35'. The flanges 20a (20b) of the eccentric bearings 15a (15b) are no longer necessary in the modified embodiment shown in FIG. 6. Namely, in the embodiment illustrated in FIG. 6, the eccentric bearings 15a (15b) are directly rotated by the rotor (rotating plate) 35' through the engagement of the inner teeth 38 and the sector teeth 49. The rotor 35' can be electrically rotated by the motor M or manually rotated by the external lever 46 (FIG. 2). In the rotation by the motor, the rotor 35' is provided on the outer peripheral surface thereof with outer teeth 40' (FIG. 6) which can be engaged by the pinion 43 (FIG. 1).

Note that the pipe P or the whole die head is relatively rotated in the course of the roll threading.

As can be seen from the above discussion, according to the present invention, the fine adjustment of the radial position of the threading rollers can be easily carried out through the eccentric mechanism in accordance with the rotation of the rotor.

What we claim is:

1. An adjusting apparatus for a roll threading die head with a head body having a plurality of threading rollers located on an imaginary circle concentrical to an axis of a cylindrical workpiece to be threaded, wherein the improvement comprises eccentric bearings which rotatably support the corresponding threading rollers at opposite ends of the rollers and which are rotatable about axes eccentric with respect to the axes of rotation of the respective threading rollers, and a rotor which simultaneously rotates the eccentric bearings about their axes by the same angular displacement wherein said rotor is comprised of front and rear annular plates which are interconnected together, said front and rear annular plates including elongated grooves therein, said eccentric bearings having flanges with pivot pins extending therefrom into said grooves.

2. An apparatus according to claim 1, wherein each of the threading rollers is provided on an outer peripheral surface thereof with a taper thread to form a corresponding taper thread on the workpiece.

3. An apparatus according to claim 1, further comprising shafts for rotating the threading rollers, and wherein said eccentric bearings are provided with eccentric holes in which the shafts are rotatably fitted.

4. An apparatus according to claim 3, wherein the axes of said shafts are eccentric with respect to the axes of the rotation of the respective eccentric bearings.

5. An apparatus according to claim 1, further comprising an external gear provided on the head body, and wherein said rotor is provided with outer teeth which are in mesh with the external gear.

6. An adjusting apparatus for a roll threading die head with a head body having a plurality of threading rollers located on an imaginary circle concentrical to an axis of a cylindrical workpiece to be threaded, wherein the improvement comprises eccentric bearings which rotatably support the corresponding threading rollers at opposite ends of the rollers and which are rotatable about axes eccentric with respect to the axes of rotation of the respective threading rollers, and a rotor which simultaneously rotates the eccentric bearings about their axes by the same angular displacement, said rotor including front and rear rotatable annular plates which are interconnected together and which have inner teeth, said eccentric bearings including outer teeth which are engaged by the inner teeth of the annular plates.

* * * * *